US006698598B1

(12) United States Patent
Appenteng

(10) Patent No.: US 6,698,598 B1
(45) Date of Patent: Mar. 2, 2004

(54) GREETING CARD DISPLAY APPARATUS

(76) Inventor: Kwame Appenteng, 2380 Mickle Ave., Bronx, NY (US) 10469

( * ) Notice: Subject to any disclaimer, the term of this patent is extended or adjusted under 35 U.S.C. 154(b) by 0 days.

(21) Appl. No.: 09/971,889

(22) Filed: Oct. 5, 2001

(51) Int. Cl.[7] ..... A47F 7/16
(52) U.S. Cl. ..... 211/45; 211/96; 211/168
(58) Field of Search ..... 211/45, 196, 205, 211/168, 172, 96, 18, 46; 40/124

(56) References Cited

U.S. PATENT DOCUMENTS

| | | | | | |
|---|---|---|---|---|---|
| 223,963 | A | * | 1/1880 | Taylor | 248/290.1 |
| 284,286 | A | * | 9/1883 | Downing | 211/171 |
| 345,741 | A | * | 7/1886 | Thurston | 211/172 |
| 429,022 | A | * | 5/1890 | Etzel | 211/96 |
| 796,676 | A | * | 8/1905 | Rogers | 211/96 |
| 949,066 | A | * | 2/1910 | Fowler | 211/174 |
| 1,046,319 | A | * | 12/1912 | Mohney | 211/100 |
| 1,050,235 | A | * | 1/1913 | Scanlan | 248/70 |
| 1,089,290 | A | * | 3/1914 | Thompson | 248/165 |
| 1,410,240 | A | * | 3/1922 | Beaver | 211/100 |
| 1,711,587 | A | * | 5/1929 | Brunhoff | 211/168 |
| 1,839,607 | A | * | 1/1932 | Slauson | 211/168 |
| 1,933,981 | A | * | 11/1933 | Householder | 211/96 |
| 2,126,513 | A | * | 8/1938 | Sterrett | 211/97 |
| 2,165,654 | A | * | 7/1939 | Rosenthal | 211/41.11 |
| 2,512,725 | A | * | 6/1950 | Mock, Jr. | 343/797 |
| 2,587,111 | A | * | 2/1952 | Cashen, Jr. | 211/1.3 |
| 2,708,324 | A | * | 5/1955 | Wedden | 211/196 |
| 3,478,893 | A | * | 11/1969 | Crosslen | 211/165 |
| 3,599,360 | A | | 8/1971 | Lappo | |
| 3,618,885 | A | * | 11/1971 | Muller | 248/460 |
| 3,789,526 | A | | 2/1974 | Lavinson | |
| 3,798,592 | A | * | 3/1974 | Lilly | 340/908 |
| 3,987,566 | A | | 10/1976 | March | |
| 4,127,195 | A | * | 11/1978 | Portnoy | 211/100 |
| 4,315,376 | A | | 2/1982 | Eichenauer | |
| 4,358,110 | A | * | 11/1982 | Youkstetter | 273/450 |
| 4,399,172 | A | * | 8/1983 | DeCosmo | 428/8 |
| 4,402,487 | A | * | 9/1983 | Donnelly | 254/133 R |
| 4,626,972 | A | * | 12/1986 | Wolf | 362/251 |
| 4,632,255 | A | * | 12/1986 | Kennedy | 211/1.3 |
| 4,767,013 | A | * | 8/1988 | Bertelli | 211/96 |
| 5,038,946 | A | * | 8/1991 | Tenser et al. | 211/168 |
| 5,190,170 | A | * | 3/1993 | Steiner | 211/104 |
| 5,199,680 | A | * | 4/1993 | Rivera | 248/441.1 |
| 5,280,840 | A | * | 1/1994 | Terpening | 211/165 |
| D344,248 | S | | 2/1994 | Wiggins | |
| 5,458,249 | A | * | 10/1995 | Shang-Lu | 211/197 |
| 5,473,312 | A | * | 12/1995 | Duran | 340/612 |
| 5,975,317 | A | | 11/1999 | Roebling | |
| 6,135,612 | A | * | 10/2000 | Clore | 362/184 |
| 6,227,680 | B1 | * | 5/2001 | Arndt | 362/248 |

* cited by examiner

*Primary Examiner*—Daniel P. Stodola
*Assistant Examiner*—Khoa Tran

(57) ABSTRACT

A greeting card display apparatus for displaying greeting cards. The greeting card display apparatus includes a housing having a channel designed to rest on a support surface. The housing has a plurality of display arm assemblies which are selectively couplable to the housing and pivot sideways with respect to the housing for the purpose of paging through the greeting cards. The display arms are telescopic thereby allowing them to adjust to various sizes of cards. There is a lighted section at the top of the housing for ornamental purposes, and the housings are designed as a stand-alone version, one that can encompass a circular member such as a Christmas tree, or one designed to be coupled to a flat or corner wall surface.

1 Claim, 7 Drawing Sheets

GREETING CARD DISPLAY APPARATUS

BACKGROUND OF THE INVENTION

1. Field of the Invention

The present invention relates to greeting card displays and more particularly pertains to a new greeting card display apparatus for displaying greeting cards.

2. Description of the Prior Art

The use of greeting card displays is known in the prior art. More specifically, greeting card displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,315,376; U.S. Pat. No. 3,789,526; U.S. Pat. No. 3,987,566; U.S. Pat. No. Des. 344,248; U.S. Pat. No. 5,975,317; and U.S. Pat. No. 3,599,360.

While these devices fulfill their respective, particular objectives and requirements, the aforementioned patents do not disclose a new greeting card display apparatus. The inventive device includes a housing having a channel designed to rest on a support surface. The housing has a plurality of display arm assemblies which are selectively couplable to the housing and pivot sideways with respect to the housing for the purpose of paging through the greeting cards. The display arms are telescopic thereby allowing them to adjust to various sizes of cards. There is a lighted section at the top of the housing for ornamental purposes, and the housings are designed as a stand-alone version, one that can encompass a circular member such as a Christmas tree, or one designed to be coupled to a flat or corner wall surface.

In these respects, the greeting card display apparatus according to the present invention substantially departs from the conventional concepts and designs of the prior art, and in so doing provides an apparatus primarily developed for the purpose of displaying greeting cards.

SUMMARY OF THE INVENTION

In view of the foregoing disadvantages inherent in the known types of greeting card displays now present in the prior art, the present invention provides a new greeting card display apparatus construction wherein the same can be utilized for displaying greeting cards.

The general purpose of the present invention, which will be described subsequently in greater detail, is to provide a new greeting card display apparatus which has many of the advantages of the greeting card displays mentioned heretofore and many novel features that result in a new greeting card display apparatus which is not anticipated, rendered obvious, suggested, or even implied by any of the prior art greeting card displays, either alone or in any combination thereof.

To attain this, the present invention generally comprises a housing having a channel designed to rest on a support surface. The housing has a plurality of display arm assemblies which are selectively couplable to the housing and pivot sideways with respect to the housing for the purpose of paging through the greeting cards. The display arms are telescopic thereby allowing them to adjust to various sizes of cards. There is a lighted section at the top of the housing for ornamental purposes, and the housings are designed as a stand-alone version, one that can encompass a circular member such as a Christmas tree, or one designed to be coupled to a flat or corner wall surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures and systems for carrying out the several purposes of the present invention. It is important, therefore, that the claims be regarded as including such equivalent constructions insofar as they do not depart from the spirit and scope of the present invention.

It is therefore an object of the present invention to provide a new greeting card display apparatus apparatus and method which has many of the advantages of the greeting card displays mentioned heretofore and many novel features that result in a new greeting card display apparatus which is not anticipated, rendered obvious, suggested, or even implied by any of the prior art greeting card displays, either alone or in any combination thereof.

It is another object of the present invention to provide a new greeting card display apparatus which may be easily and efficiently manufactured and marketed.

It is a further object of the present invention to provide a new greeting card display apparatus which is of a durable and reliable construction.

An even further object of the present invention is to provide a new greeting card display apparatus which is susceptible of a low cost of manufacture with regard to both materials and labor, and which accordingly is then susceptible of low prices of sale to the consuming public, thereby making such greeting card display apparatus economically available to the buying public.

Still yet another object of the present invention is to provide a new greeting card display apparatus which provides in the apparatuses of the prior art some of the advantages thereof, while simultaneously overcoming some of the disadvantages normally associated therewith.

Still another object of the present invention is to provide a new greeting card display apparatus for displaying greeting cards.

Yet another object of the present invention is to provide a new greeting card display apparatus which includes a housing having a channel designed to rest on a support surface. The housing has a plurality of display arm assemblies which are selectively couplable to the housing and pivot sideways with respect to the housing for the purpose of paging through the greeting cards. The display arms are telescopic thereby allowing them to adjust to various sizes of cards. There is a lighted section at the top of the housing for ornamental purposes, and the housings are designed as a stand-alone version, one that can encompass a circular member such as a Christmas tree, or one designed to be coupled to a flat or corner wall surface.

Still yet another object of the present invention is to provide a new greeting card display apparatus that displays cards in a fashion that allows them to be clearly seen and enjoyed.

Even still another object of the present invention is to provide a new greeting card display apparatus that is producible in various sizes and designs to accommodate a number of different cards and room decor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
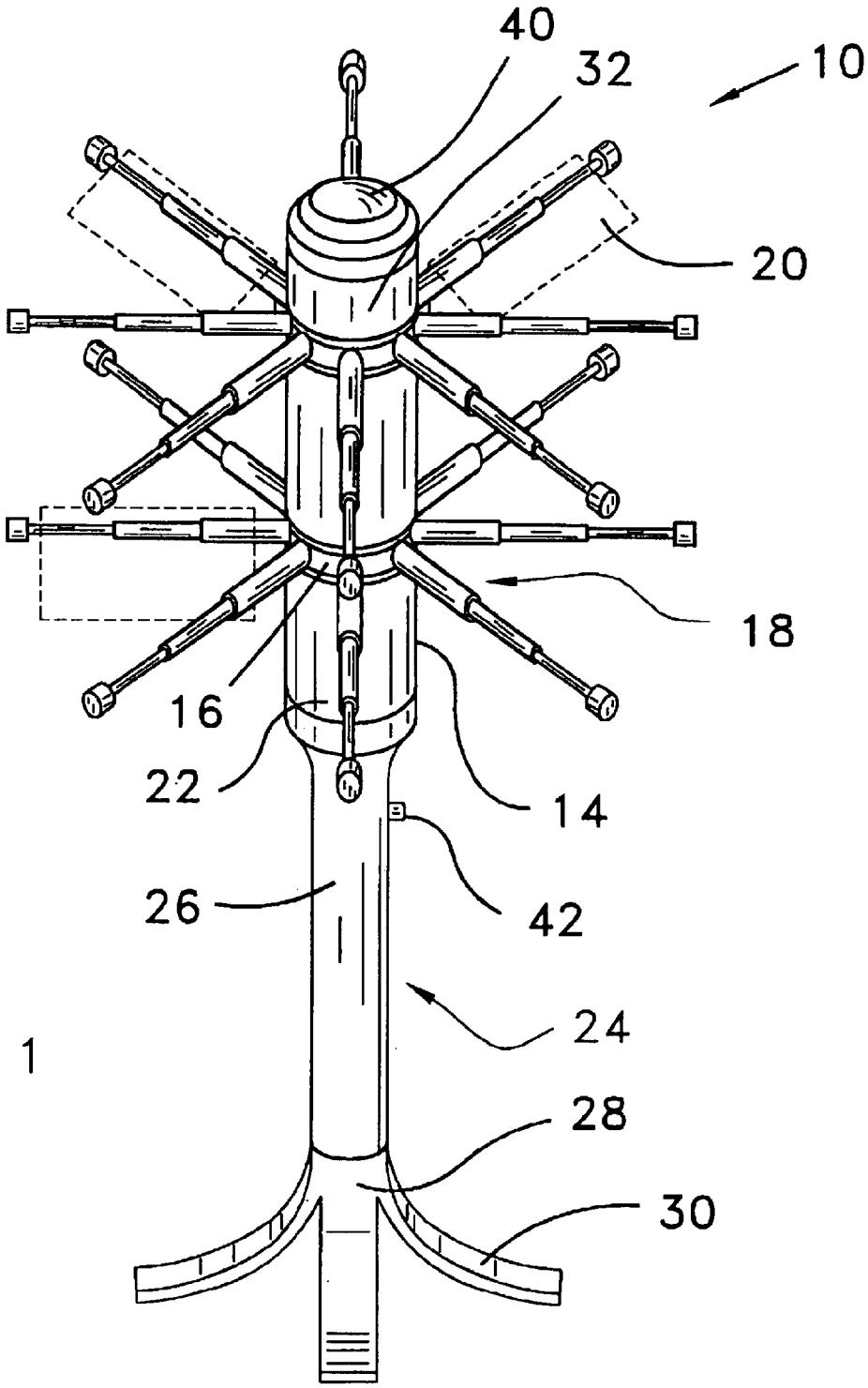
FIG. 1 is a perspective view of the standard stand-alone version of the present invention.
Figure 2:
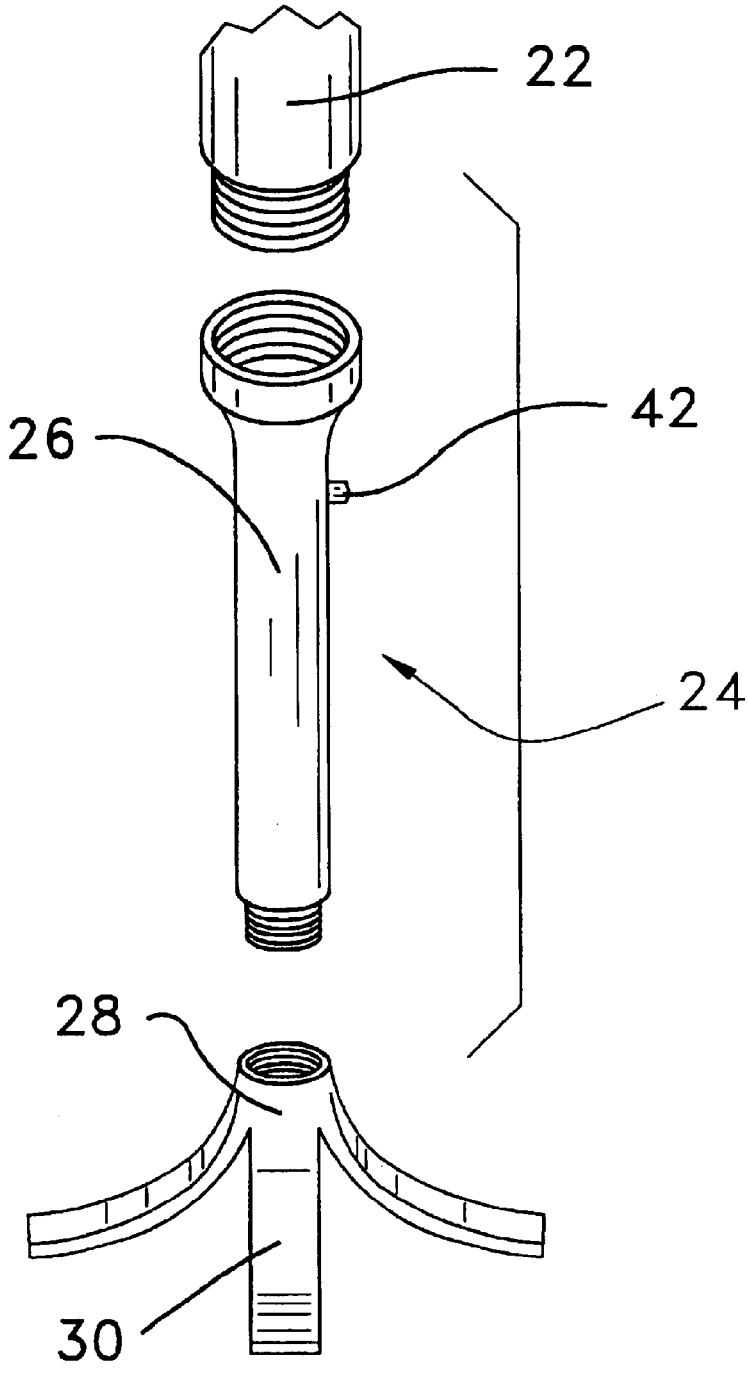
FIG. 2 is an exploded view of the lower portion of the housing of the present invention.
Figure 3:
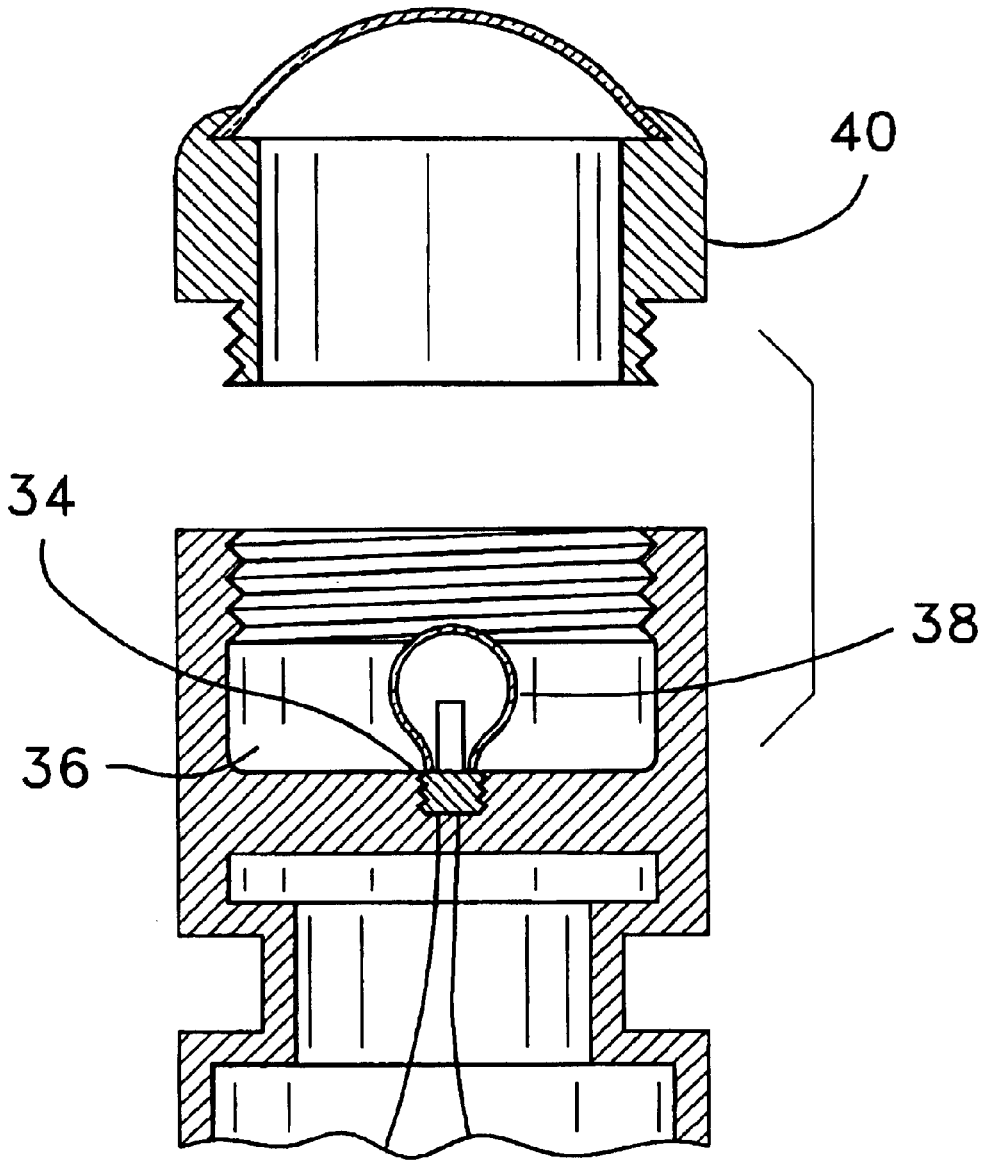
FIG. 3 is a cross-sectional view of the lighting assembly of the present invention.
Figure 4:
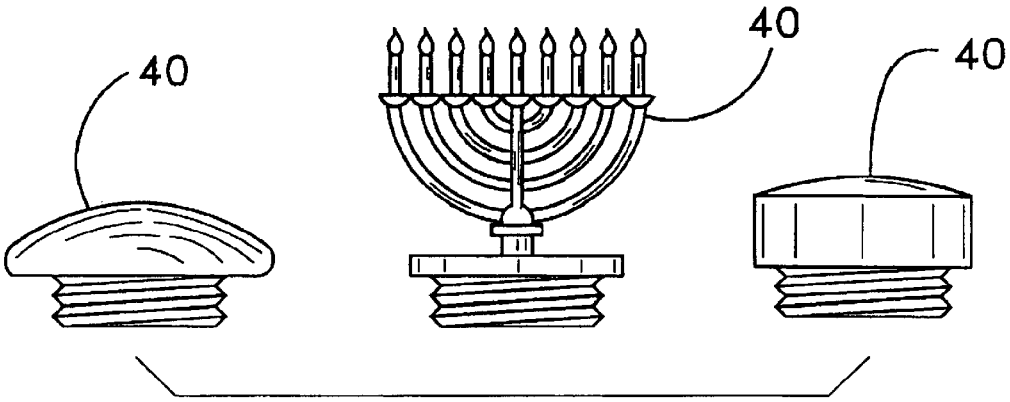
FIG. 4 is a side view of an example of the different types of globes of the present invention.
Figure 5:
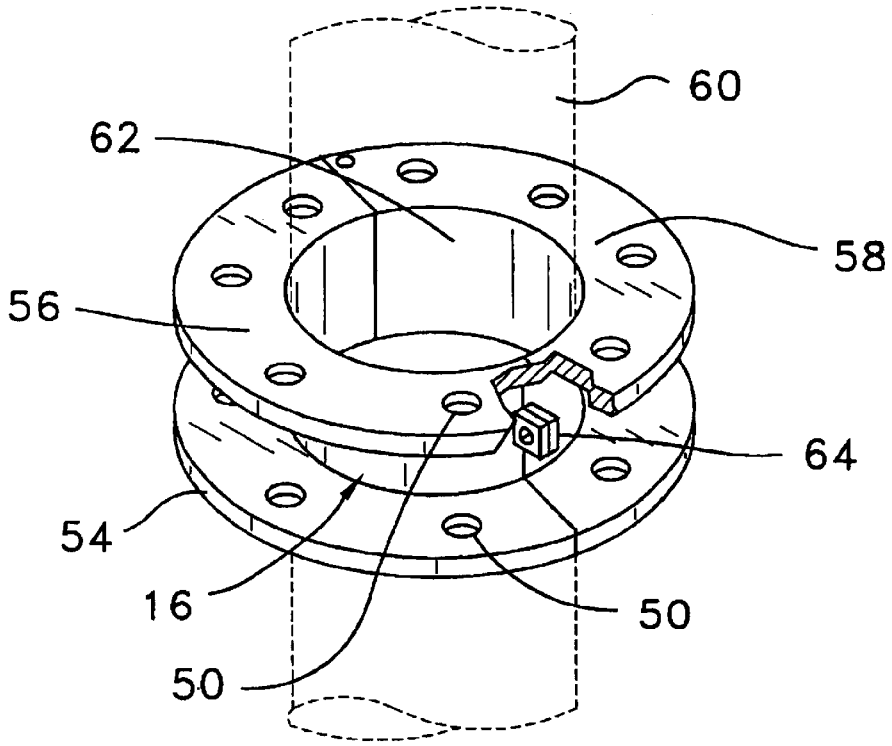
FIG. 5 is a perspective view of the collar version of the present invention.
Figure 6:
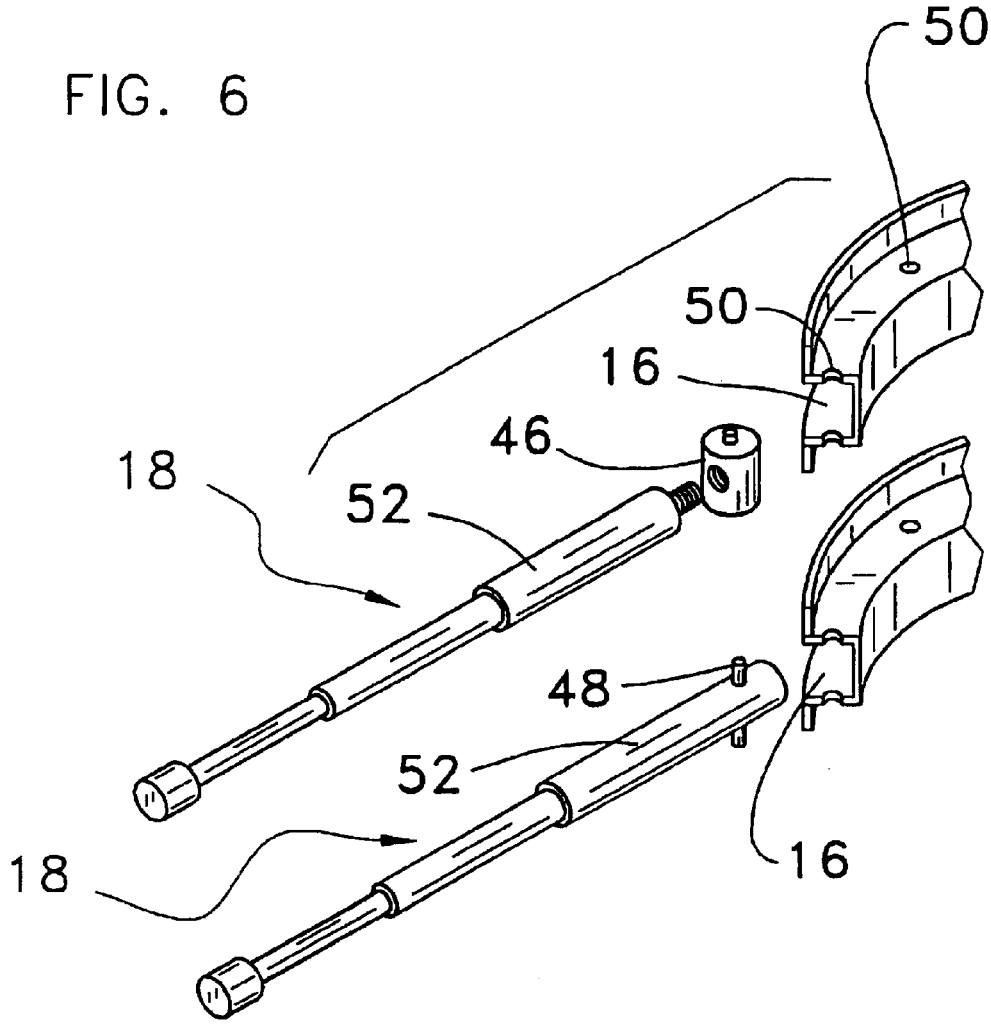
FIG. 6 is a perspective view of the two different types of telescopic arms of the present invention.
Figure 7:
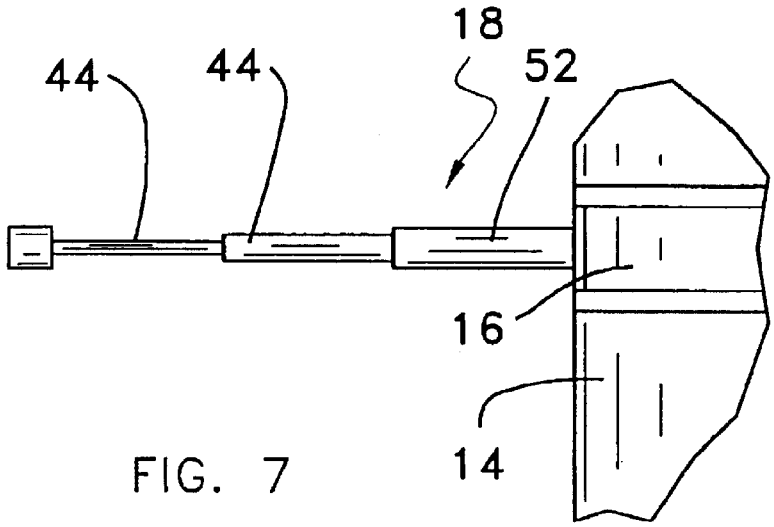
FIG. 7 is a side view of the telescopic arm assembly of the present invention.
Figure 10:
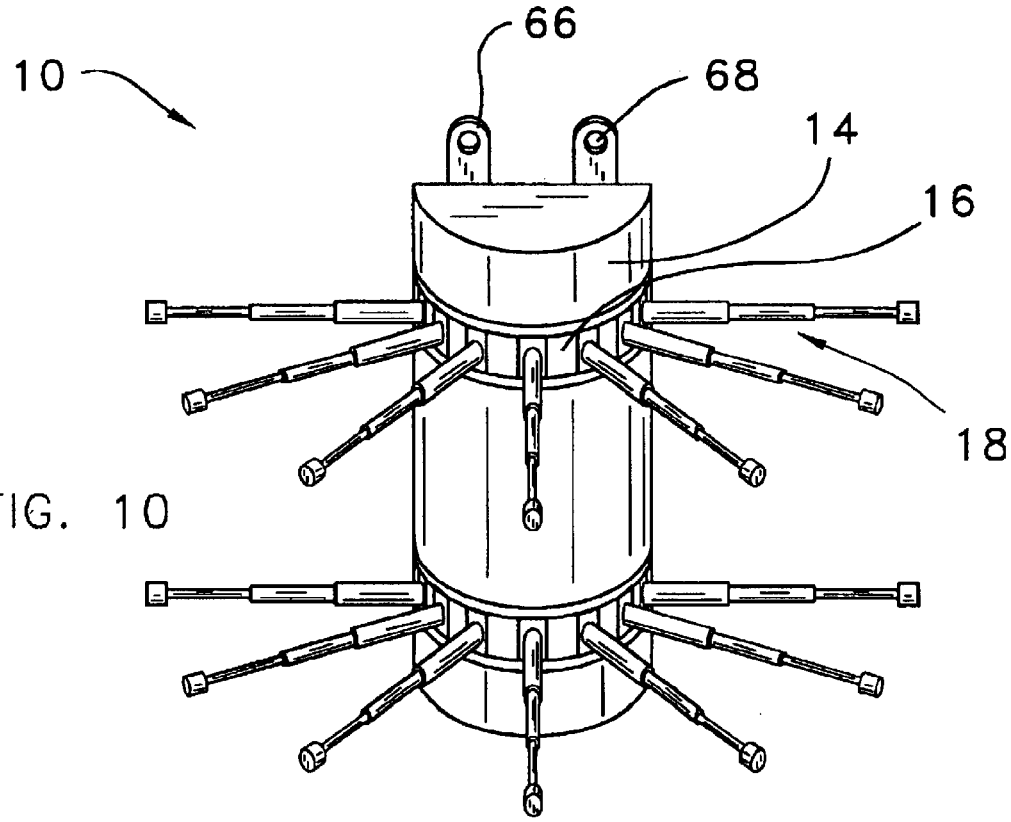
FIG. 10 is a perspective view of the flat wall-mounted version of the present invention.
Figure 9:
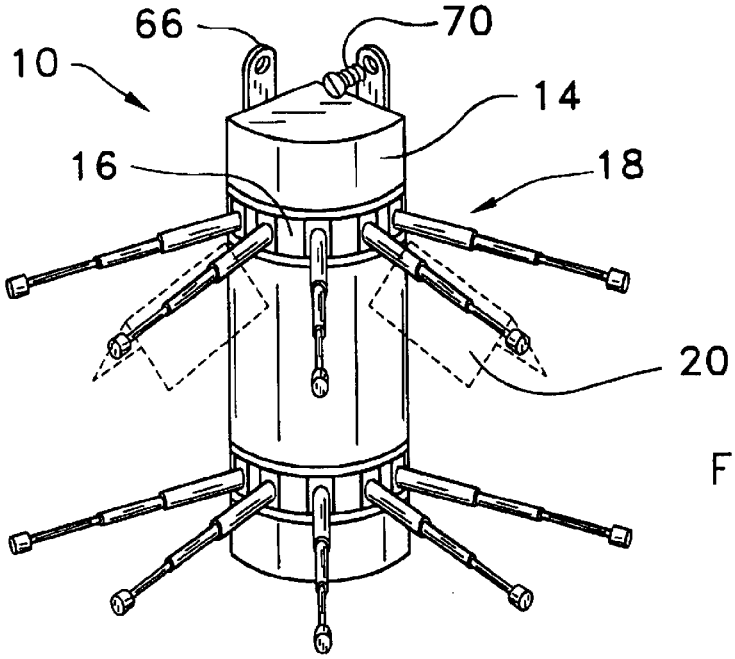
FIG. 9 is a perspective view of the corner wall-mounted version of the present invention.
Figure 8:
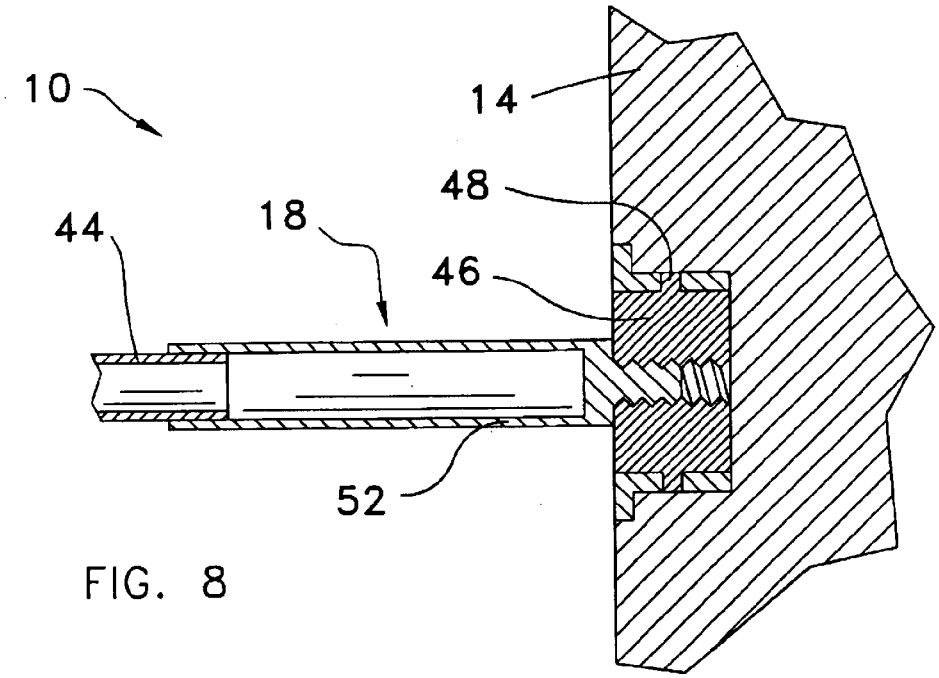
FIG. 8 is a cross-sectional view of the telescopic arm assembly of the present invention.

With reference now to the drawings, and in particular to FIGS. 1 through 10 thereof, a new greeting card display apparatus embodying the principles and concepts of the present invention and generally designated by the reference numeral 10 will be described.

As best illustrated in FIGS. 1 through 10, the greeting card display apparatus 10 generally comprises a housing 14 designed for resting on a surface. The housing 14 has at least one channel 16.

A plurality of display arm assemblies 18 is coupled to the housing 14. Each of the display arm assemblies 18 is selectively couplable to the channel 16 of the housing 14. Each of the display arm assemblies 18 is designed for displaying greeting cards 20.

The housing 14 has a lower end 22 couplable to a stanchion assembly 24. The stanchion assembly 24 is designed for resting on a surface and supporting the housing 14 from the surface.

The stanchion assembly 24 has a stanchion member 26 selectively coupled to the lower end 22 of the housing 14. The stanchion assembly 24 has a base member 28 couplable to the stanchion member 26 opposite the housing 14. The base member 28 is designed for resting on the surface and supporting the housing 14.

The base member 28 has a plurality of legs 30. Each of the legs 30 is positioned diametrically from another of the legs 30. Each of the legs 30 is designed for engaging the surface.

The housing 14 has an upper end 32. The upper end 32 receives a lighting assembly 34 designed for emitting light.

The light assembly has a base portion 36. The base portion 36 is couplable to the upper end 32 of the housing 14. A light emitting member 38 is positioned within the base portion 36 of the light assembly. The light emitting member 38 is designed for emitting light.

The light assembly has a globe portion 40. The globe portion 40 is coupled to the base portion 36. The globe member is designed for dispersing light emitted by the light emitting member 38.

The light emitting member 38 is operationally coupled to a switch 42. The switch 42 is operationally coupled to a power source and is designed for controlling power from the power source to the light emitting device.

Each of the display arm assemblies 18 has a plurality of telescopic arms 44. Each of the telescopic arms 44 is telescopically extendable with respect to an adjacent one of the telescopic arms 44 for permitting a variable length of the telescopic arms 44.

Each of the display arm assemblies 18 has a connector member 46. The connector member 46 has a pair of locking pins 48. Each of the locking pins 48 engages one of a plurality of bores 50 of the channel 16.

The telescopic arms 44 have a base arm 52. The connector member 46 is for receiving the base arm 52 such that the locking pins 48 of the connector member 46 permit the telescopic arms 44 to be rotated with respect to the housing 14.

As an alternate embodiment, the housing 14 has a perimeter wall 54. The channel 16 extends into the perimeter wall 54. The perimeter wall 54 comprises a first collar member 56 and a second collar member 58. The second collar member 58 is coupled to the first collar member 56 such that the first collar member 56 and the second collar member 58 are designed for being positioned around a support member 60.

The first collar member 56 and the second collar member 58 each have an arcuate inner face 62. The arcuate inner face 62 of the first collar member 56 and the second collar member 58 is designed for engaging the support member 60 for supporting the housing 14 and display arm assemblies 18.

The first collar member 56 and the second collar member 58 each have a locking flange 64. The first collar member 56 is hingably coupled to the second collar member 58. The locking flange 64 of the first collar member 56 is aligned with the locking flange 64 of the second collar member 58 when the first collar member 56 and the second collar member 58 engage the support member 60 such that the locking flange 64 of the first collar member 56 is engagable with the locking flange 64 of the second collar member 58 for securing the first collar member 56 to the second collar member 58.

As an alternate embodiment, the housing 14 has a plurality of tabs 66. Each of the tabs 66 has an aperture 68. The aperture 68 of each of the tabs 66 is designed for receiving a fastener 70 for securing the housing 14 to a wall surface.

As an alternate embodiment, the base arm 52 of the telescopic arms 44 has a pair of the locking pins 48. Each of the locking pins 48 engages one of the plurality of bores 50 of the channel 16. The locking pins 48 permit the telescopic arms 44 to be rotated with respect to the housing 14.

In general, the globes positioned atop the lighting assembly can be of a variety of designs to allow the user to vary the amount of light emitted, or to display different ornamental designs for particular occasions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A display apparatus for displaying cards, the display apparatus comprising:

a housing being adapted for resting on a surface, said housing having at least one channel;

a plurality of display arm assemblies being coupled to said housing, each of said display arm assemblies being selectively couplable to said channel of said housing, each of said display arm assemblies being adapted for displaying cards of a user;

said housing having a lower end, said lower end of said housing being couplable to a stanchion assembly, said stanchion assembly being adapted for resting on a surface and supporting said housing from the surface;

said stanchion assembly having a stanchion member, said stanchion member being selectively coupled to said lower end of said housing, said stanchion assembly having a base member, said base member being couplable to said stanchion member opposite said housing, said base member being adapted for resting on the surface and supporting said housing;

said base member having a plurality of legs, each of said legs being positioned diametrically from another of said legs, each of said legs being adapted for engaging the surface;

said housing having an upper end, said upper end receiving a lighting assembly, said lighting assembly being adapted for emitting light;

said light assembly having a base portion, said base portion being couplable to said upper end of said housing, a light emitting member being positioned within said base portion of said light assembly, said light emitting member being adapted for emitting light;

said light assembly having a globe portion, said globe portion being coupled to said base portion, said globe member being adapted for dispersing light emitted by said light emitting member;

said light emitting member being operationally coupled to a switch, said switch being adapted for operationally coupled to a power source, said switch being adapted for controlling power from the power source to said light emitting device;

each of said display arm assemblies having a plurality of telescopic arms, each of said telescopic arms being telescopically extendable with respect to an adjacent one of said telescopic arms for permitting a variable length of said telescopic arms, each of said telescopic arms being slidably extending from an interior of an adjacent one of said telescopic arms such that each of said telescopic arms are extendable, an outermost one of said telescopic arms of each of said display arm assemblies having a tip, each of said tips of said display arm assemblies having a diameter that is relatively larger than a diameter of said outermost telescopic arm on which it is mounted;

each of said display arm assemblies having a connector member, said connector member having a pair of locking pins, each of said locking pins engaging one of a plurality of bores of said channel;

said telescopic arms having a base arm, said connector member being for receiving said base arm such that said locking pins of said connector member permit said telescopic arms to be rotated with respect to said housing.

* * * * *